US005861084A

United States Patent [19]

Barker et al.

[11] Patent Number: 5,861,084

[45] Date of Patent: Jan. 19, 1999

[54] SYSTEM AND METHOD FOR MINIMIZING HORIZONTAL VIBRATION OF ELEVATOR COMPENSATING ROPES

[75] Inventors: Frederick H. Barker, Bristol; Peter O. Erlandsen, South Glastonbury, both of Conn.

[73] Assignee: Otis Elevator Company, Farmington, Conn.

[21] Appl. No.: 832,403

[22] Filed: Apr. 2, 1997

[51] Int. Cl.[6] ..... B66B 11/08

[52] U.S. Cl. ..... 187/264; 187/414

[58] Field of Search ..... 187/264, 267, 187/166, 254, 278, 345, 414, 411

[56] References Cited

U.S. PATENT DOCUMENTS 2,215,021 9/1940 Vallen ..... 187/264

4,522,285 6/1985 Salmon et al. ..... 187/264

*Primary Examiner*—Kenneth Noland

[57] ABSTRACT

Tension of compensating ropes in an elevator system is electively changed to minimize horizontal vibration of the compensating ropes in tall buildings. The tension of compensating ropes is changed by a tensioning mechanism either when the horizontal movement of the compensating ropes exceeds a preset limit or when the building sway exceeds a predetermined amount. Additionally, the tension of compensating ropes can be changed when the elevator car is parked within certain predetermined top floors. The tension can be applied to a compensating sheave supporting the compensating ropes by a tensioning mechanism such as a hydraulic jack.

7 Claims, 1 Drawing Sheet

SYSTEM AND METHOD FOR MINIMIZING HORIZONTAL VIBRATION OF ELEVATOR COMPENSATING ROPES

TECHNICAL FIELD

The present invention relates to elevator systems and, more particularly, to a system for detecting and reducing horizontal vibration of compensating ropes therefor.

BACKGROUND OF THE INVENTION

A typical elevator system comprises an elevator car and a counterweight, each suspended on opposite ends of hoist ropes disposed in an elevator hoistway. Compensating ropes are hung from the underside of the elevator car to the underside of the counterweight to balance the weight of the hoist ropes as the car and counterweight move alternatingly up and down within the hoistway. A compensating rope sheave, disposed on the bottom of the hoistway, allows the compensating ropes to pass therethrough.

A problem with compensating ropes arises in tall buildings, which tend to sway, as a result of winds acting upon the buildings. Under certain combinations of rope length and tension, the compensating ropes tend to vibrate with the building. The compensating ropes' motion may continuously gain amplitude as the result of the building sway. The problem of horizontal rope vibration tends to be worse when the elevator car is parked near top floors because the compensating ropes are the longest and the building sway, which excites the rope vibration, is greatest.

Such horizontal vibration of the compensating ropes is undesirable for a number of reasons. First, compensating ropes may get tangled with one another since elevators have many compensating ropes or may interfere with other cables in the hoistway. Second, horizontal movement of ropes limits the ability of the elevator car to travel at higher speeds, because the shortening of the vibrating ropes resulting from an elevator car traveling downward will increase the oscillations of the ropes, thereby inhibiting the ropes' ability to stay within the grooves of the compensating sheave. Third, the noise from the compensating ropes hitting the hoistway walls may frighten passengers and building occupants.

One common method for minimizing horizontal movement of compensating ropes is to increase the weight of a frame supporting the compensating sheave. The major drawback of increasing the dead weight on the compensating sheave is that the suspended dead weight becomes live load which must be supported by the elevator machine, thereby requiring increased capacity of the machine itself and the increased size of the associated powertrain hardware.

Another approach to dampen oscillations of the compensating ropes is to use a follower carriage attached to the ropes. However, this approach has the same major shortcoming as the use of suspended dead weights. The elevator machine and drive must support the additional weight of the follower carriage.

DISCLOSURE OF THE INVENTION

It is an object of the present invention to minimize the horizontal vibration of compensating ropes in tall buildings.

According to the present invention, tension in compensating ropes is selectively increased when an elevator car is parked in a critical zone, where compensating ropes will most likely resonate with the building. A tensioning mechanism is actuated by an elevator car controller to apply tension to a compensating rope sheave when the elevator car is parked in the critical zone to avoid a resonant condition. One type of such tensioning mechanism is a hydraulic cylinder coupled to the compensating rope sheave.

According to another embodiment of the present invention, tension in compensating ropes is selectively increased in response to a plurality of sensors detecting excessive horizontal movement of compensating ropes. The tension is selectively applied to a compensating sheave by the tensioning mechanism, such as a hydraulic cylinder. As sensors detect excessive horizontal vibration, the tensioning mechanism applies tension to the compensating sheave. Once the sensors detect that the excessive horizontal movement of the compensating ropes has subsided, or if the elevator car needs to travel, the tension is gradually released.

According to a further embodiment of the present invention, tension can be selectively applied to the compensating rope sheave if a pendulum sensor detects excessive swaying of the building. Many machine rooms of high rise elevators are typically equipped with pendulum sensors.

The present invention eliminates the need for the permanent weight being carried by the compensating ropes or sheaves, thereby allowing a smaller size elevator machine and drive. The present invention also allows faster downward travel of the elevator car, even during building sway on a windy day.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
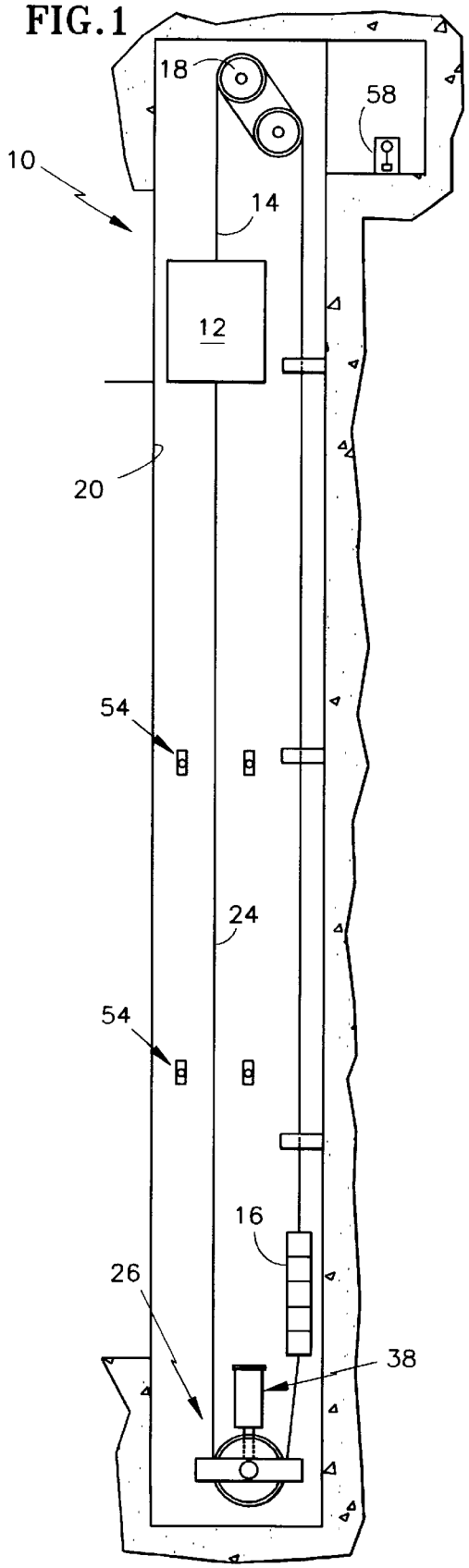
FIG. 1 is a schematic representation of an elevator system with a tensioning mechanism for compensating ropes and a compensating sheave, according to the present invention.

Referring to FIG. 1, an elevator system 10 includes an elevator car 12 suspended from one end of a plurality of hoist ropes 14 and a counterweight 16 suspended on another end of the hoist ropes 14 which are supported by a hoisting sheave 18 disposed on top of a hoistway 20. A plurality of compensating ropes 24 is dispensed from a compensating sheave assembly 26 and is hung from the underside of the elevator car 12 to the underside of the counterweight 16 to balance the weight of the hoist ropes 14.

Figure 2:
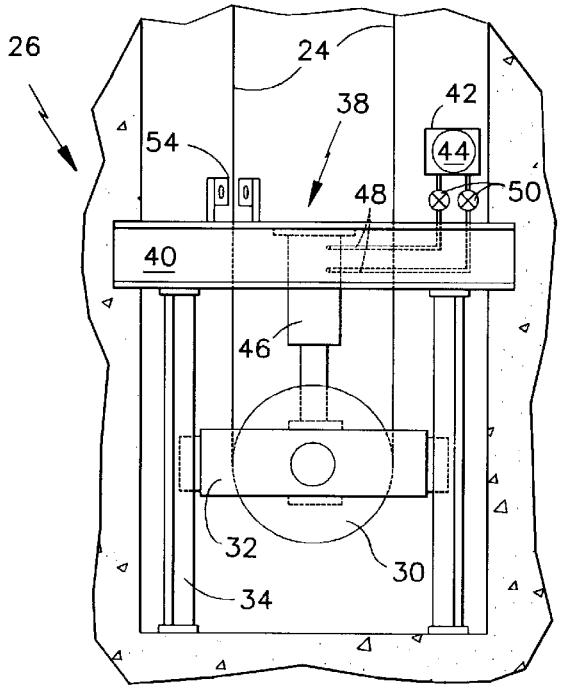
FIG. 2 is an enlarged, schematic view of the compensating sheave tension mechanism of FIG. 1, according to the preferred embodiment of the present invention.

Referring to FIG. 2, the compensating sheave assembly 26 includes a compensating sheave 30 enclosed in a housing 32 moving vertically along a plurality of guide rails 34, as is known in the art. A tensioning mechanism 38 is coupled to the compensating sheave 30 and is supported by a bracket 40. The tensioning mechanism 38 includes a hydraulic tank 42 with a pump and motor 44 placed therein and connected to a hydraulic piston 46 by tubing 48 and controlled by a plurality of valves 50.

A plurality of sensors 54 are disposed within the hoistway 20, as can be seen in FIG. 1. The sensors 54 are placed on each side of the hoistway 20 across the compensating rope path and are spaced away from the path of the compensating rope 24 by a predetermined distance. A pendulum sensor 58 is disposed within the top portion of the hoistway 20.

In operation, when the elevator car 12 is parked on the top floors of a building, the compensating ropes 24 hang down and have the greatest length. When the building sways, as a result of winds, the compensating ropes 24 tend to move horizontally. If the horizontal movement exceeds a predetermined distance, the excessive movement of the compensating ropes is detected by the sensors 54. A signal is then sent to the tensioning mechanism 38 to apply tension to the compensating sheave 30. The hydraulic piston 46 of the tensioning mechanism 38 is activated with the pump generating pressure. The piston 46 applies tension to the compensating sheave 30, forcing it to glide downward along the rails 34. The downward movement of the sheave 30 changes tension in the compensating ropes 24, thereby minimizing the horizontal vibration thereof. Once the sensors 54 stop detecting excessive movement of the compensating ropes 24, a signal is sent to gradually release pressure from the hydraulic piston 46 and remove induced tension from the compensating sheave 30. Also, a command to release pressure from the hydraulic piston 46 and to remove tension from the compensating sheave 30 is sent if the elevator car 12 needs to travel.

In an alternate embodiment of the present invention, an elevator car controller is preprogrammed to increase the tension of the compensating ropes when the elevator car is parked within a critical zone. The critical zone can be defined individually for each elevator and usually includes the top floors of tall buildings, but may include a zone of floors elsewhere in the building. Once the elevator car controller "knows" that the elevator is parked in the critical zone, as can be detected by a variety of means known in the art, a signal is sent to the tensioning mechanism 38 to increase tension on the compensating sheave 30, thereby minimizing the compensating ropes' tendency to vibrate resonantly with the building. The elevator car controller sends a signal to release tension once the elevator car needs to travel.

In a further embodiment of the present invention, the tensioning mechanism 38 is activated once the pendulum sensor 58 detects that the building sway exceeds a predetermined limit. Once the pendulum sensor detects excessive building sway, a signal is sent to the controller. The controller then sends a signal to the tensioning mechanism to apply tension to the compensating sheave and ropes.

By selectively applying tension to a compensating sheave 30 when excessive horizontal movement of compensating ropes 24 is detected, the present invention prevents the compensating ropes 24 from interfering with other ropes and from hitting the hoistway walls. Since tension is induced when the elevator car is parked, and the elevator machine brake is applied, the selective application of tension also eliminates the need for a larger and more powerful elevator machine and the associated hardware, thereby resulting in space savings within the machine room and cost savings for the machine and associated powertrain hardware.

Although the preferred embodiment of the present invention describes a hydraulic tensioning mechanism, a screw jack can be also used to selectively apply tension to the compensating sheave. A variety of sensors can be used to detect horizontal movement of the compensating ropes.

While the present invention has been illustrated and described with respect to a particular embodiment thereof, it should be appreciated by those of ordinary skill in the art, that various modifications to this invention may be made without departing from the spirit and scope of the present invention.

We claim:

1. A method for minimizing horizontal movement of compensating ropes in an elevator system, said method comprising the steps of:

sensing horizontal movement of said compensating ropes that exceeds a preset limit; and applying tension to said compensating ropes once said preset limit is exceeded to minimize horizontal movement of said compensating ropes.

2. A method for minimizing horizontal movement of compensating ropes in an elevator system, said method comprising the steps of:

sensing building sway that exceeds a predetermined limit; and applying tension to said compensating ropes once said predetermined limit is exceeded to minimize horizontal movement of said compensating ropes.

3. A method for minimizing horizontal movement of compensating ropes of an elevator car in an elevator system, said method comprising the steps of:

detecting when said elevator car is parked on certain predetermined floors of a building; and applying tension to said compensating ropes once said elevator car is parked on said certain predetermined floors of said building to minimize horizontal movement of said compensating ropes.

4. A system for minimizing horizontal movement of compensating ropes of an elevator car, said system comprising:

a tensioning mechanism for selectively applying tension to said compensating ropes to minimize horizontal movement of said compensating ropes, wherein said tensioning mechanism is a screw jack applying tension selectively to a compensating sheave supporting said compensating ropes.

5. A system for minimizing horizontal movement of compensating ropes of an elevator car, said system comprising:

a tensioning mechanism for selectively applying tension to said compensating ropes to minimize horizontal movement of said compensating ropes when said elevator car is parked on certain predetermined floors of a building.

6. A system for minimizing horizontal movement of compensating ropes of an elevator car, said system comprising:

a plurality of sensors for sensing excessive horizontal movement of said compensating ropes; and a tensioning mechanism for selectively applying tension to said compensating ropes to minimize horizontal movement of said compensating ropes once said plurality of sensors detects excessive horizontal movement of said compensating ropes.

7. A system for minimizing horizontal movement of compensating ropes of an elevator car, said system comprising:

a pendulum sensor sensing excessive sway of a building; and a tensioning mechanism for selectively applying tension to said compensating ropes to minimize horizontal movement of said compensating ropes once said pendulum sensor detects excessive swaying of said building.

* * * * *